US009010989B2

(12) United States Patent
Rayner et al.

(10) Patent No.: US 9,010,989 B2
(45) Date of Patent: Apr. 21, 2015

(54) CONTAINER SYSTEM

(75) Inventors: Josh Rayner, Houston, TX (US); Michael Woodmansee, Houston, TX (US); Laurent Coquilleau, Houston, TX (US); Philip Zsiga, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 808 days.

(21) Appl. No.: 12/423,426

(22) Filed: Apr. 14, 2009

(65) Prior Publication Data

US 2009/0257303 A1 Oct. 15, 2009

Related U.S. Application Data

(60) Provisional application No. 61/124,061, filed on Apr. 14, 2008.

(51) Int. Cl.

| | |
|---|---|
| ***B01F 5/02*** | (2006.01) |
| ***B01F 5/00*** | (2006.01) |
| ***B01F 15/00*** | (2006.01) |

(52) U.S. Cl.

CPC ..... *B01F 5/0068* (2013.01); *B01F 5/02* (2013.01); *B01F 15/00876* (2013.01)

(58) Field of Classification Search

CPC ..... B01F 5/0068; B01F 5/0074; B01F 5/02; B01F 5/0206; B01F 15/00876

USPC ..... 366/30, 33, 34, 131, 134, 165.1, 165.2, 366/165.4

See application file for complete search history.

(56) References Cited

U.S. PATENT DOCUMENTS

| | | | | |
|---|---|---|---|---|
| 2,603,460 | A | 7/1952 | Kalinske | |
| 2,887,306 | A * | 5/1959 | Egger | 366/134 |
| 5,029,645 | A | 7/1991 | Allen | |
| 5,103,908 | A | 4/1992 | Allen | |
| 7,284,898 | B2 | 10/2007 | Duell et al. | |
| 2003/0043688 | A1 | 3/2003 | Peterson et al. | |
| 2004/0156262 | A1 | 8/2004 | Roberts et al. | |
| 2006/0239112 | A1 * | 10/2006 | Graeber | 366/3 |

FOREIGN PATENT DOCUMENTS

| | | |
|---|---|---|
| DE | 1557197 | 3/1970 |
| EP | 0616109 | 9/1991 |
| EP | 0419280 | 11/1994 |
| EP | 1745840 | 1/2007 |
| FR | 2570618 | 3/1986 |
| WO | 9519221 | 7/1995 |
| WO | 9915265 | 4/1999 |
| WO | 2007077427 | 7/2007 |

OTHER PUBLICATIONS

English-language machine translation of DE 1557197(A1).*

* cited by examiner

*Primary Examiner* — Timothy Cleveland

(74) *Attorney, Agent, or Firm* — Jeffrey R. Anderson; Rachel E. Greene; Michael Flynn

(57) ABSTRACT

A method and system for providing a homogenized slurry output comprises a container body defining an interior portion, a discharge for supplying the slurry from the container body to a downstream source and at least one inlet in fluid communication with a pressurized supply of slurry for introducing the slurry into the interior portion of the container body in a circulation pattern that creates a homogenized mixture of slurry in the interior portion of the body.

12 Claims, 2 Drawing Sheets

CONTAINER SYSTEM

CROSS-REFERENCE TO RELATED APPLICATION

This application is entitled to the benefit of, and claims priority to, provisional patent application 61/124,061 filed Apr. 14, 2008, the entire disclosure of which is incorporated herein by reference.

BACKGROUND

The statements in this section merely provide background information related to the present disclosure and may not constitute prior art. The system and method relate in general to oilfield equipment such as, but not limited to, offshore platforms and oilfield support vessels, such as well stimulation vessels and equipment.

Cement slurries are pumped between a casing and the earth during the construction of a wellbore to, for example, ensure zonal isolation between geologic formations. The slurry should be mixed at a precise proportion of dry cement blend and mix fluid to achieve the desired density. Once it is fully blended, the slurry is pumped at a pre-determined rate into the wellbore. In order for the cementing operation to be successful, the density and downhole rates must be accurately maintained throughout the job. Failure to operate within these job parameters may necessitate further remedial cementing operations or can even result in the complete loss of the well.

A continuous mixing process typically includes a container or "mix tub" into which mixed cement slurry is introduced, and from which that slurry is pumped downhole. Since variations in slurry density commonly occur during continuous mixing, the mix tub serves to homogenize the slurry and stabilize the slurry density before it is sent to the downhole pumps. A well-distributed velocity profile within the tub volume assists with homogenization.

The mix tub also acts as a reservoir that buffers the downhole pumping rate from variability in the cement slurry mixing rate. Since the volume of slurry in the tub may vary when there are interruptions in the slurry mixing rate, the mix tub must be effective over a wide range of resident slurry volumes. Only the portion of slurry in the mix tub that is actively circulating within the tub contributes to volumetric averaging of slurry properties. Dead volumes, such as non-circulating or slow circulating volumes, reduce the effective averaging volume of the tub.

It is desirable to minimize the amount of residual cement slurry remaining in the mix tub after the cementing operation has been completed. Since cement slurry is a solid suspension, sludge residues are common in regions of low velocity, called "dead spots." Cement residue may tend to build up over time inside the mix tub, occasionally becoming so thick that it interferes with the cement mixing system when it hardens over time and then breaks free. Therefore, it is desirable to maintain high slurry velocities near all wetted surfaces to reduce the buildup of sludge residues. If a strong velocity gradient occurs near wetted surfaces at all times, then the tub can be said to be intrinsically self-cleaning, as residue buildup will be severely limited.

The mix tub must not cause the slurry to ingest air, which can reduce the slurry density and can have adverse effects on the pumping system. Strong inward flows from the free surface, such as is caused by the common practice of injecting the incoming slurry jet into the tub from above, entrains air and draws it into the resident slurry volume.

Since continuous mixing is a process dependent on the rates of delivery of the mixture constituents, the level of fluid in the mix tub will vary whenever there are disturbances in the incoming cement and fluid flows or when there are changes in the discharge slurry rate. The mix tub is also pumped empty at the end of a cement job, as well as between phases requiring different slurry formulations. Therefore, the mix tub must perform all of its principal functions over a wide range of fluid levels.

The above features in existing mix tubs are typically provided through the use of an agitation device, baffles, and/or extra volume. With an agitation device, a mechanical agitation device (such as a paddle mixer) is used to induce fluid movement within the tub. The effectiveness in homogenization diminishes with distance from the agitation device, which means that high fluid velocities are not maintained on all wetted surfaces within the tub. This approach is also undesirable, because it adds cost and complexity to the system. Baffles are used in the tub to enforce a certain pattern of fluid flow. This approach is undesirable, because a baffle always creates a dead spot upstream that encourages separation, sedimentation and accelerates cement build-up. When only part of the tub volume is activated into circulation, the overall tub volume is typically increased to compensate for dead volumes in order to maintain the true averaged volume. A common solution to this problem is to add a separate averaging tub with a volume that may be two to three times that of the mix tub in order to increase the effective averaging volume. This extra averaging tub disadvantageously increases the size of the system and adds complexity to the cementing system.

It is desirable, therefore, to use a mix tub or container that provides a desired slurry behavior in the tub without requiring baffles or a supplemental agitation device.

SUMMARY

An embodiment of a container system comprises a container body defining an interior portion, a discharge for supplying the slurry from the container body to a downstream source and at least one inlet in fluid communication with a pressurized supply of slurry for introducing the slurry into the interior portion of the container body in a circulation pattern that creates a homogenized mixture of slurry in the interior portion of the body. Alternatively, at least one inlet creates a high velocity flow of slurry at a lower surface of the interior portion of the container body. Alternatively, at least one inlet is disposed proximate to the discharge. Alternatively, the circulation pattern rotates generally around a horizontal axis of the container body. Alternatively, at least one inlet is a pair of inlets disposed on opposite sides of the discharge. Alternatively, the downstream source is a wellbore. The at least one inlet may be a nozzle.

Alternatively, the slurry is a cement slurry. Alternatively, the interior portion of the container body comprises a bottom surface that is sloped upwards from a front wall to a back wall. The angled of the sloped surfaces may increase incrementally as the bottom surface approaches the back wall. Alternatively, the circulation pattern allows the container body to be substantially self-cleaning. Alternatively, the container body comprises no deep corners thereby avoiding the formation of dead spots in the slurry volume and/or circulation pattern. Alternatively, the circulation pattern is driven entirely by the kinetic energy of the fluid entering the tub through the at least one inlet. Alternatively, the circulation is accomplished without the use of external agitators or the like. Alternatively, the system creates the circulation pattern for a predetermined range of resident slurry volumes.

In an embodiment, a method for providing a homogenized slurry output comprises providing a container system comprising a container body defining an interior portion, a discharge for supplying the slurry to a downstream destination and at least one inlet in fluid communication with a pressurized supply of slurry, introducing a supply of slurry into the interior portion of the container body, creating a circulation pattern that creates a homogenized mixture of slurry in the interior portion of the body, and discharging the slurry from the container body to the downstream source. Alternatively, the downstream source is a wellbore. Alternatively, introducing comprises at least one inlet creating a high velocity flow of slurry at a lower surface of the interior portion of the container body. Alternatively, providing comprises disposing the at least one inlet proximate to the discharge.

Alternatively, creating comprises creating the circulation pattern that rotates generally around a horizontal axis of the container body. Alternatively, introducing comprises introducing a cement slurry. Alternatively, providing comprises providing an interior portion of the container body that comprises a bottom surface that is sloped upwards from a front wall to a back wall. The angle of the sloped surface may increase incrementally as the bottom surface approaches the back wall. Alternatively, the circulation flow allows the container body to be substantially self-cleaning. Alternatively, the container body comprises no deep corners thereby avoiding the formation of dead spots in the slurry volume and/or circulation pattern. Alternatively, creating comprises driving the circulation pattern entirely by the kinetic energy of the fluid entering the container through the at least one nozzle. Alternatively, the circulation is accomplished without the use of external agitators or the like. Alternatively, the system induces the circulation pattern for a predetermined range of resident slurry volumes.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
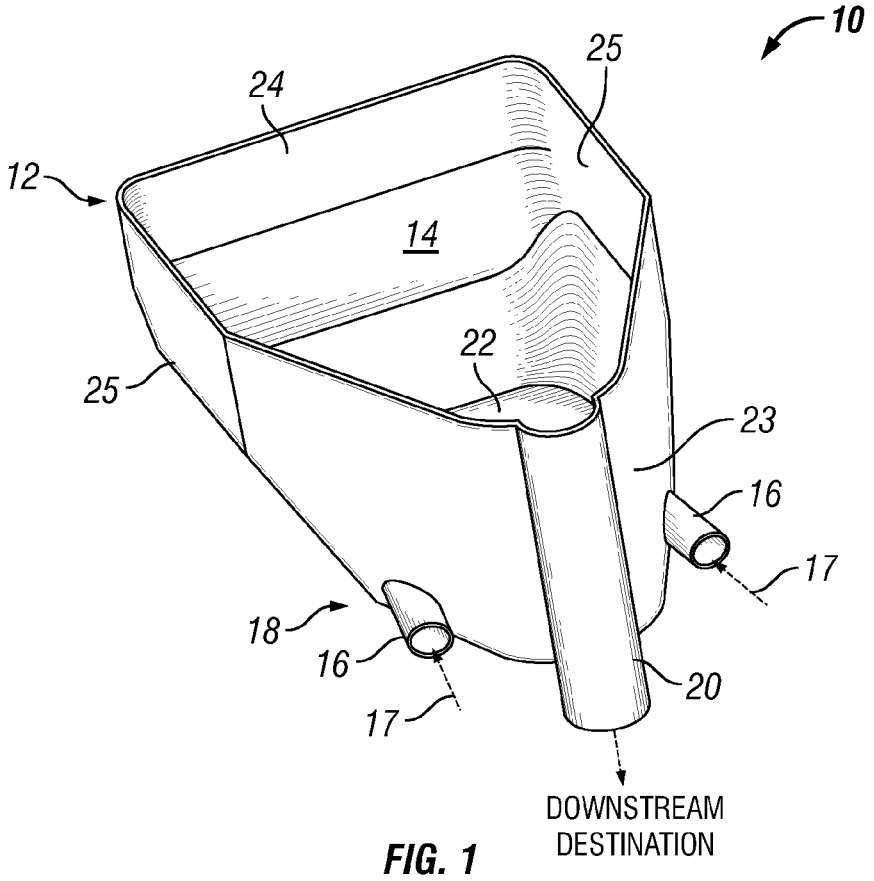
FIG. 1 is a perspective schematic view of an embodiment of a container system.

Referring now to all of the Figures, an embodiment of a mix tub or container system is indicated generally at 10. The mix tub or container system 10 comprises a tub or container body 12 defining an interior portion 14. The interior portion 14 of the container body 12 is defined by a lower surface 22, a front wall 23, a back wall 24, and a plurality of side walls or surfaces 25. A pair of inlets 16 is mounted near a bottom portion 18 of the tub body 12. Those skilled in the art will appreciate that the number of inlets 16 may vary from one inlet 16 to a plurality of inlets 16, depending on the requirements of the system 10. The inlets 16 may be in fluid communication with a pressurized source of slurry, indicated schematically at 17. The inlets 16 may be nozzles. The interior portion 14 of the tub body 12 adjacent the inlets 16 is preferably free of obstructions. The slurry 17 is supplied to the interior portion 14 of the tub body 12 via the inlets 16 near to, but away from a tub discharge 20. The discharge 20 may be in fluid communication with a downstream destination such as a wellbore or the like.

The inlets 16 are arranged such that the angle of injection from the inlets 16 creates a mild incidence angle with the tub bottom surface 22. The entraining effect of the injected slurry on the circulating slurry in the tub is enhanced as the jet spreads out on the tub bottom surface 22. Circulation in the tub body interior 14 is therefore driven entirely by the kinetic energy of the fluid entering the tub through the inlet or inlets 16, and forms a circulation pattern, indicated generally by a plurality of arrows at 21 within the interior 14 of the container body 12. This configuration advantageously puts the entire fluid volume of the slurry 17 in motion and preferably gives the slurry 17 a uniform residence time within the interior portion 14 of the tub body 12.

The tub injection inlets 16 may be mounted near the discharge 20 and oriented to direct the slurry 17 away from the discharge 20 in order to circulate the full tub volume. By injecting the slurry near the discharge 20, the entire resident volume of the slurry in the interior 14 of the tub body 12 is drawn into the circulation pattern 21, discussed in more detail below. This aspect of the inlet 16 configuration and/or placement advantageously ensures that there are no short-circuit flows or dead spots in the circulation pattern 21 within the tub interior 14.

Figure 2:
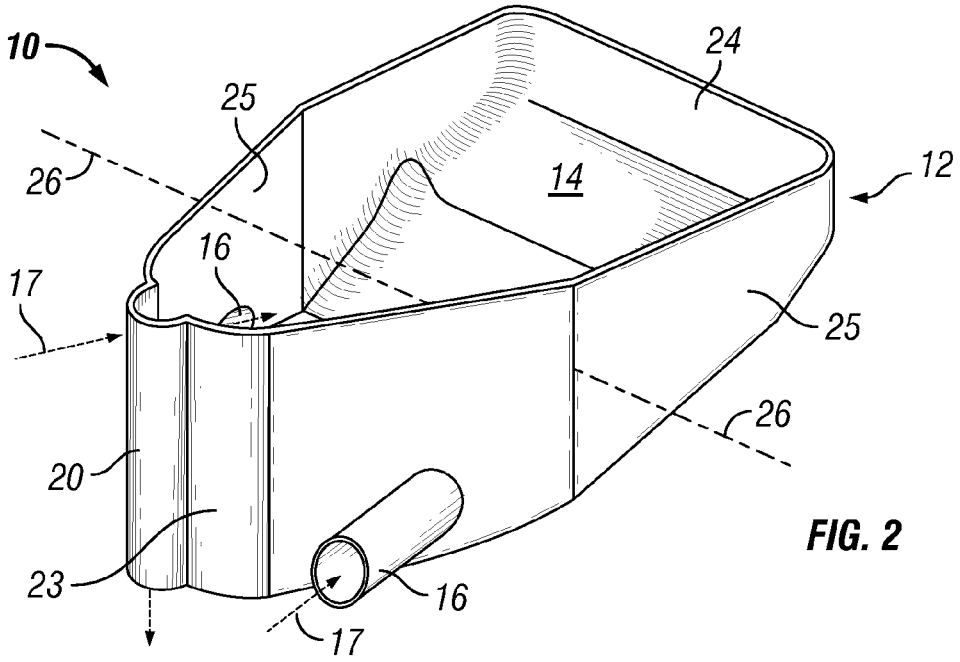
FIG. 2 is another perspective schematic view of the container system.

The tub or container bottom surface 22 may be sloped upwards slightly between a front wall 23 and the back wall 24. The angle of the bottom surface 22 may increase incrementally as the bottom surface 22 approaches the back wall 24 from the front wall 23, best seen in FIG. 2*b*. The geometry of the container bottom surface 22 and interior 14, in combination with the placement of the injection nozzles 16 and discharge 20, creates the circulation flow or pattern 21 that rotates generally around an axis, such as a substantially horizontal axis, indicated by an arrow 26. The circulation pattern 21 has been discovered through simulation and experiments to activate the entire slurry volume and creates a strong flow at the tub walls of the interior portion 14 and advantageously produces the desired flow pattern 21 for a wide range of slurry 17 levels within the interior 14, advantageously providing consistent performance for a wide range of resident slurry volumes. The range of slurry volumes may be a predetermined range of slurry volumes. The circulation pattern 21 preferably allows the mix tub 10 to be substantially self-cleaning in that few dead spots or low velocity points within the flow pattern 21 are located adjacent the interior walls 22, 23, 24, or 25 of the container 14. The circulation pattern 21 shown in FIG. 2 illustrates exemplary and non-limiting circulation flows, as will be appreciated by those skilled in the art.

The placement of the inlet or inlets 16 and the geometry of the surfaces 22, 23, 24, or 25 of the container body 14 contribute to the circulation pattern 21, thereby ensuring that mixing, homogenization, and dead spots are optimized. The circulation flow pattern 21 and high velocity zones in the interior portion 14 may be chosen based on geometry of the container body 12, whose dimensions and/or profile may vary based on design considerations, space or packaging restrictions and the like but those skilled in the art will appreciate that the specific geometry of the container body 16 as shown may be varied. In an embodiment, the inlets 16 and tub body 12 are designed and/or arranged with one or more axis of symmetry, which creates a predictable and constant flow pattern that reduces splashing and equalizes particle residence time inside the tub body interior 14.

In the illustrated embodiment of the container body 12, deep corners (such as those formed by three mutually perpendicular planes) are eliminated from all wetted surfaces of the container body 12, which advantageously avoids the formation of dead spots in the volume of slurry 17 in the interior 14 of the container body 12 and/or the circulation pattern 21. The shallow corners of the container body 12 also advantageously enhance the ease of manually or otherwise cleaning the interior 14 of the body 12. Furthermore, air entrainment is substantially eliminated since the fluid slurry 17 is injected at or near the bottom surface 22, which allows the slurry 17 to be entrained into the inlets 16 instead of air, which advantageously activates the entire tub volume into circulation.

Figure 3:
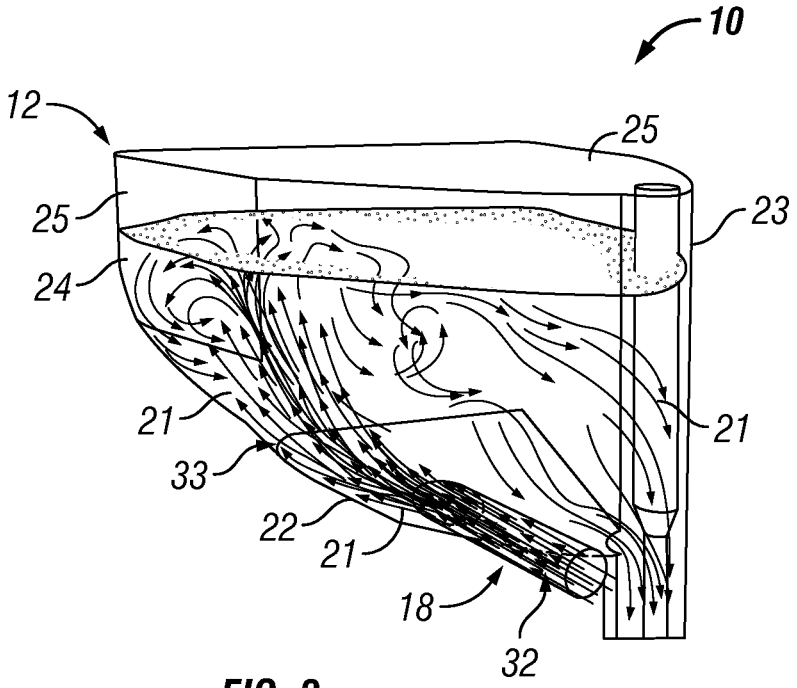
FIG. 3 is a schematic view of the container system showing slurry flow therein.
Figure 4:
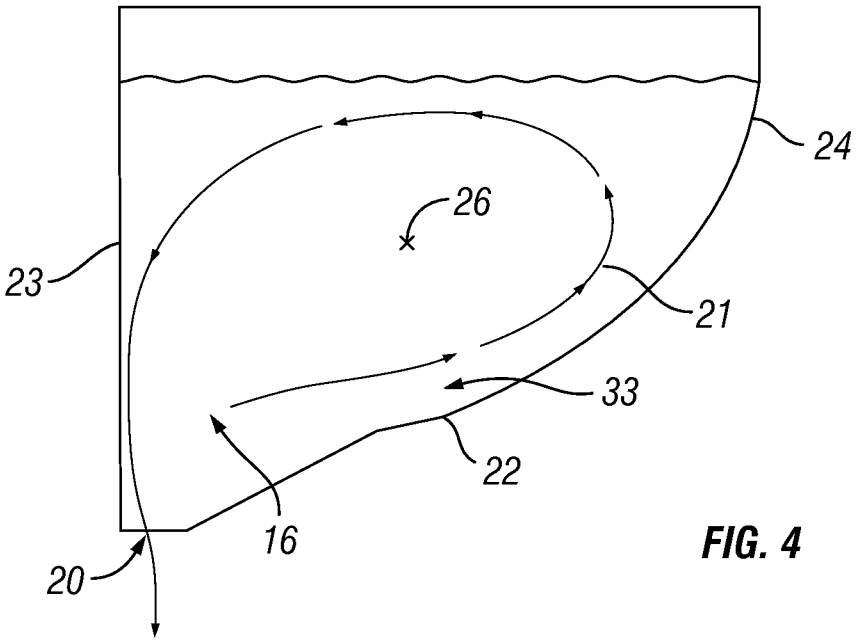
FIG. 4 is a schematic side view of the container system showing slurry flow therein.

Referring now to FIG. 3, the circulation pattern 21 is arranged such that a portion 33 of the interior 14 of the mix tub body 12 receives the greatest amount of flow or greatest velocity. In an embodiment, the portion 33 is a lower corner portion of the interior 14. In an embodiment, velocity or flow is highest at the inlet discharge 32 and is also high at the corner portion 33, advantageously allowing greater flow at those portions of the mix tub body 12, namely those portions adjacent the lower surface 22, where the slurry 17 has a tendency to settle and de-homogenize, which is discouraged by the higher velocity flow at those locations. The combination of the placement of the inlets 16 and the geometry of the container body 12, therefore, provide an advantageously efficient apparatus for mixing slurry and the like.

An embodiment of a container system 10 is used for homogenizing cement slurries in oilfield applications by advantageously utilizing slurry recirculation and the geometry of the container 12 to define the motion of fluid within the tub interior 14. While recited for use in mixing a cement slurry in oilfield applications, those skilled in the art will appreciate that the mix tub may be applicable for use in the continuous mixing and homogenization of any liquid or slurry system.

An embodiment of a container system 10 maintains high slurry velocities near all wetted surfaces 22, 23, 24, or 25 of the container 12 to reduce the potential buildup of sludge residues. By creating a strong velocity gradient near wetted surfaces 22, 23, 24, or 25, then the container 12 of the system 10 can be said to be intrinsically self-cleaning, as sludge residue buildup will be severely limited. The container system 10 also discourages the ingestion of air into the slurry 17 disposed in the interior 14 of the container body 12, as the slurry 17 is injected below a level of the slurry, rather than injecting the incoming slurry jet into the tub from above the level of the slurry 17, which may entrap air and draw it into the resident slurry volume. The container system 10 advantageously performs all of its principal functions over a wide range of fluid levels by enforcing a well-distributed velocity profile within the slurry within the container interior 14 regardless of tub level, advantageously maximizing homogenization and minimizing the likelihood of settling.

An embodiment of the container system 10 achieves the principal functions of continuously homogenizing slurry and buffering the slurry discharge rate from variations in mixing rate without the assistance of mechanical agitation within the tub or container 12. Instead, the energy in the container interior 14 used for homogenization is derived entirely from the kinetic energy of the incoming fluid. The rolling circulation pattern attained inside the tub or container ensures that the tub bottom surface and upper edges of the slurry free surface, those regions most susceptible to accumulating cement sludge, see the highest fluid velocities. This rolling circulation also puts the entire slurry volume in motion in the container interior 14, creating a uniform residence time for each slurry volume injected and allows most of the slurry to pass by the free surface, enhancing air removal. Because the container 12 shape creates the rolling circulation pattern at all tub operating levels, the performance of the mix tub is largely independent of the slurry volume contained within. Finally, by injecting the incoming slurry at or near the bottom surface 22 of the container 12, air ingestion within the container is substantially reduced and preferably eliminated.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A container system comprising:

a container body defining an interior portion that comprises a plurality of side surfaces, and a bottom surface extending between a front wall and a back wall, wherein the bottom surface is sloped upwards from the front wall to the back wall, wherein an angle at which the bottom surface is sloped increases incrementally as the bottom surface approaches the back wall from the front wall which contributes to the performance of the container body in maintaining high slurry velocities near all wetted surfaces of the plurality side surfaces, the bottom surface, the front wall and the back wall of the container body to reduce the potential buildup of sludge residues;

an inlet for introducing a pressurized fluid into the interior portion of the container body in a circulation pattern that creates a homogenized mixture of slurry in the interior portion of the container body; and a discharge for moving slurry from the container body to a downstream destination.

2. The system of claim 1, wherein a position of the inlet relative to the bottom surface and a position of the discharge relative to the inlet contribute to the circulation pattern, and wherein the performance of the container body in creating the circulation pattern to continuously homogenize the slurry is independent of a slurry level within the interior portion of the container body.

3. The system of claim 2, wherein a geometry of the container body, which includes the bottom surface that is sloped upwards from the front wall to the back wall, contributes to the performance of the container body in creating the circulation pattern to continuously homogenize the slurry that is independent of the slurry level within the interior portion of the container body.

4. The system of claim 2, wherein the inlet is positioned relative to the bottom surface such that an angle of injection of a jet of fluid from the inlet is at an incidence angle with the bottom surface, and wherein the angle of injection from the inlet and the angle of the sloped bottom surface are both upward relative to the container body such that a portion of the bottom surface that is positioned to receive a greatest amount of flow from the inlet is higher relative to the container body than is the inlet.

5. The system of claim 4, wherein the bottom surface is configured to direct the jet of fluid upwardly as the jet spreads out on the bottom surface.

6. The system of claim 2, wherein the discharge is at a lower end of the container body and the inlet is higher relative to the container body than is the discharge.

7. The system of claim 1, wherein the circulation pattern allows the container body to be substantially self-cleaning.

8. The system of claim 1, wherein the circulation pattern is driven entirely by the kinetic energy of the fluid entering the interior portion of the container body through the inlet.

9. The system of claim 1, wherein the system induces the circulation pattern for a predetermined range of resident slurry volumes.

10. The system of claim 1, wherein the container body is devoid of baffles such that slurry is permitted to move within the interior portion of the container body and exit from the interior portion of the container body without interacting with a baffle.

11. The system of claim 1, wherein the inlet is configured to introduce a cement slurry into the interior portion of the container body.

12. The system of claim 1, further comprising an additional inlet for introducing a pressurized fluid into the interior portion of the container body, wherein the inlets are disposed on opposite sides of the discharge and extend from the front wall.

* * * * *